US009756906B1

(12) United States Patent
Fink

(10) Patent No.: US 9,756,906 B1
(45) Date of Patent: Sep. 12, 2017

(54) CLOSURE APPARATUS

(71) Applicant: Fastech, Inc., Canton, MA (US)

(72) Inventor: Matthew Fink, Weston, MA (US)

(73) Assignee: Fastech, Inc., Canton, MA (US)

( * ) Notice: Subject to any disclaimer, the term of this patent is extended or adjusted under 35 U.S.C. 154(b) by 148 days.

(21) Appl. No.: 14/557,203

(22) Filed: Dec. 1, 2014

(51) Int. Cl.
*A44B 11/25* (2006.01)
*A44B 17/00* (2006.01)

(52) U.S. Cl.
CPC ..... *A44B 17/0041* (2013.01); *A44B 17/0011* (2013.01)

(58) Field of Classification Search
CPC ..... Y10T 24/45178; Y10T 24/45257; Y10T 24/45948; Y10T 24/45775; Y10T 24/3424; Y10T 24/3416; Y10T 24/45545; A44B 11/258; A44B 11/2596; A44B 17/0041; A44B 17/011; A44C 5/2085; A41F 1/006
USPC ..... 450/1, 58, 91; 24/683
See application file for complete search history.

(56) References Cited

U.S. PATENT DOCUMENTS 1,376,613 A 5/1921 Forsell
2,522,109 A 9/1950 Foltis
2,912,984 A 11/1959 Jensen
3,200,464 A 8/1965 Cousins
4,000,544 A * 1/1977 Fildan ..... A41C 3/02 24/312
5,380,238 A 1/1995 Crew-Gee
D398,881 S 9/1998 France-Davis
6,009,604 A 1/2000 Fildan
D440,905 S 4/2001 Fildan et al.
6,859,982 B1 * 3/2005 Carrillo ..... A44B 11/2588 24/310

OTHER PUBLICATIONS http://img.alibaba.com/img/pb/961/652/269/1286195738435_hz-fileserver1_6501131.jpg, retrieved on Jun. 27, 2014.

* cited by examiner

*Primary Examiner* — Jack W Lavinder
(74) *Attorney, Agent, or Firm* — Pryor Cashman LLP

(57) ABSTRACT

A closure includes a male closure member including a first loop, an arm fixedly attached to the loop, and a bar fixedly attached to the arm, the bar having an upper portion extending orthogonally from the arm in a first direction and a lower portion extending orthogonally from the arm in a second direction opposite the first direction, the bar, the arm and the first loop lying substantially in a plane, and a female closure member including a second loop and a base portion fixedly attached to the second loop, the base portion having a top edge and a bottom edge and a trough extending from the bottom edge to the top edge into which the bar of the male closure member is insertable at the bottom edge and moveable along and configured for rotational pivoting of the bar in the trough, the base portion including a trough housing for receiving the upper portion of the bar inserted in the trough, the base portion having a recess configured to receive the arm attached to the bar inserted in the trough and positioned such that the upper portion of the bar is received by the trough housing, and the upper portion of the bar and the lower portion of the bar are disposed between the top edge and the bottom edge, the base portion including a pin biased to extend into the recess and configured to removably secure the arm in the recess.

3 Claims, 3 Drawing Sheets

CLOSURE APPARATUS

TECHNICAL FIELD

The present invention relates generally to closures, and particularly to closures for reversibly securing two items to one another.

BACKGROUND OF THE INVENTION

Although closures for reversibly securing two items are known in the prior art, the present invention represents an improved mechanism for securement over existing closures.

SUMMARY OF THE INVENTION

It is an object of the present invention to provide a closure mechanism that provides for reversibly securing two items. The invention is applicable to any application that requires a closure to reversibly secure two items. For example, the present invention is applicable to the field of apparel, such as the center gore for brassieres.

In general, in one aspect, the invention features a closure including a male closure member including a first loop, an arm fixedly attached to the loop, and a bar fixedly attached to the arm, the bar having an upper portion extending orthogonally from the arm in a first direction and a lower portion extending orthogonally from the arm in a second direction opposite the first direction, the bar, the arm and the first loop lying substantially in a plane, and a female closure member including a second loop, and a base portion fixedly attached to the second loop, the base portion having a top edge and a bottom edge and a trough extending from the bottom edge to the top edge into which the bar of the male closure member is insertable at the bottom edge and moveable along and configured for rotational pivoting of the bar in the trough, the base portion including a trough housing for receiving the upper portion of the bar inserted in the trough, the base portion having a recess configured to receive the arm attached to the bar inserted in the trough and positioned such that the upper portion of the bar is received by the trough housing, and the upper portion of the bar and the lower portion of the bar are disposed between the top edge and the bottom edge, the base portion including a pin biased to extend into the recess and configured to removably secure the arm in the recess.

Implementations of the invention may include one or more of the following features. The base portion of the female closure member may include a pin housing in which the pin is disposed and having an aperture through which the pin extends into the recess. The pin may be spring loaded, and the spring may be disposed in the pin housing. The male closure member and the female closure member may be formed from metal or plastic.

BRIEF DESCRIPTION OF THE FIGURES

The above-mentioned and other aspects, features and advantages can be more readily understood from the following detailed description with reference to the accompanying drawings wherein.

DETAILED DESCRIPTION OF THE INVENTION

Figure 1:
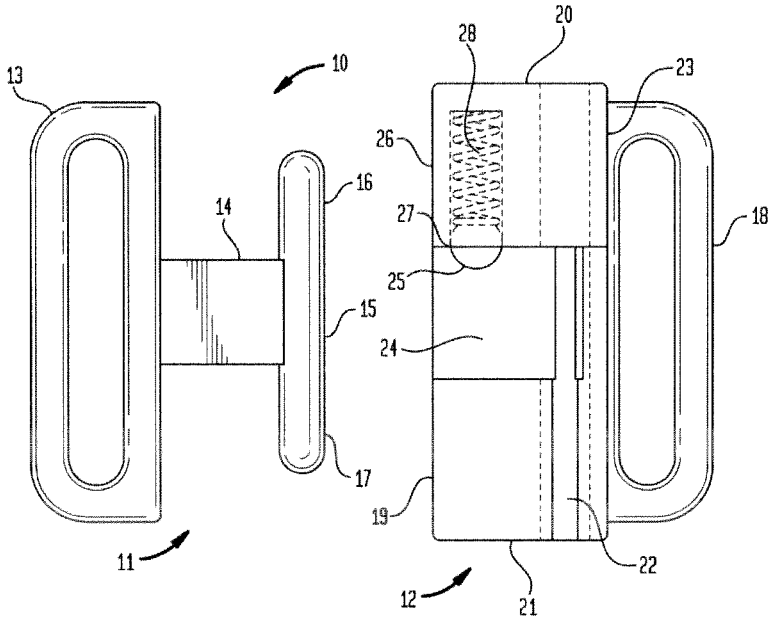
FIG. 1 shows a front view of a closure apparatus with the closure members unsecured according to an embodiment of the present invention.
Figure 3:
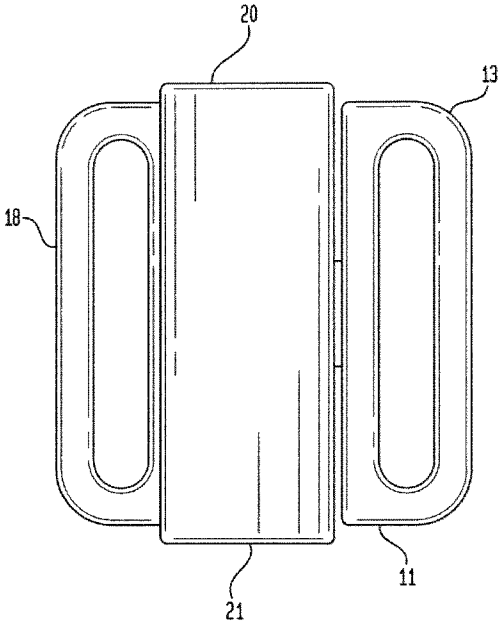
FIG. 3 is a back view of the closure apparatus of FIG. 1 with the closure members secured.
Figure 2:
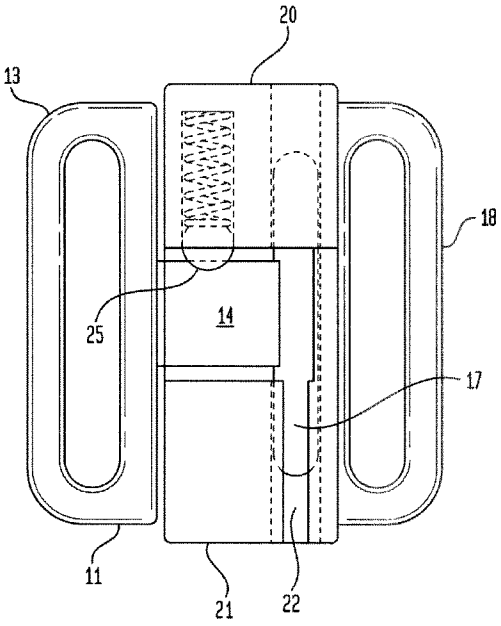
FIG. 2 is a front view of the closure apparatus of FIG. 1 with the closure members secured.
Figure 4:
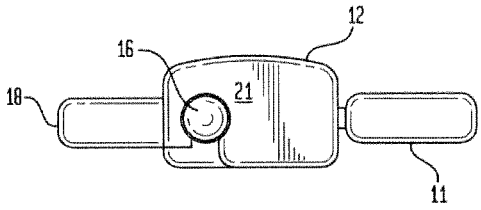
FIG. 4 is a bottom view of the closure apparatus of FIG. 1 with the closure members secured.
Figure 5:
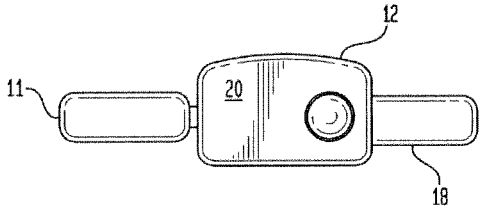
FIG. 5 is a top view of the closure apparatus of FIG. 1 with closure members secured.
Figure 6:
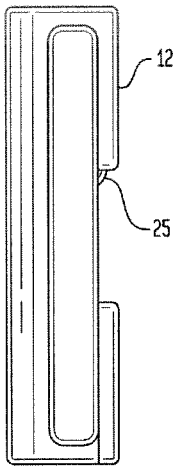
FIG. 6 is a side view of the female closure member of the closure apparatus of FIG. 1.
Figure 7:
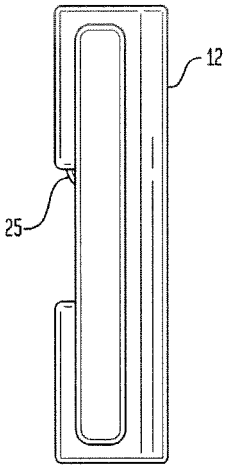
FIG. 7 is another side view of the female closure member of the closure apparatus of FIG. 1.

The present invention provides a closure 10 for reversibly securing two items together, as shown in FIGS. 1-7. Closure 10 includes two components, namely a male closure member 11 and a female closure member 12.

Male closure member 11 includes a first loop 13, an arm 14 that is fixedly attached to first loop 13, and a bar 15 that is fixedly attached to arm 14. Bar 15 has an upper portion 16 and a lower portion 17 which extend orthogonally from the arm in opposite directions. First loop 13, arm 14 and bar 15 lie substantially in the same plane.

Female closure member 12 includes a second loop 18 and a base portion 19 that is fixedly attached to the second loop 18. The base portion 19 has a top edge 20, a bottom edge 21 and a trough 22, which extends from bottom edge 21 to top edge 20. Bar 15 of the male closure member 11 can be inserted into trough 22 at the bottom edge 21 and slid along trough 22 toward top edge 20. The base portion 19 includes a trough housing 23, which is configured to receive the upper portion 16 of bar 15 when the bar is inserted into trough 22, and a recess 24 for receiving arm 14.

Bar 15 of male closure member 11 may be inserted into trough 22 at the bottom edge 21 of base portion 19 such that the plane of male closure member 11 is orthogonal to base portion 19 of female closure member 12. Bar 15 is slid along trough 22 until the upper portion 16 of bar 15 is received by trough housing 23. Male closure member 11 may then be rotatably pivoted about the bar 15 so that male closure member 11 is substantially coplanar with base portion 19 and arm 14 is received in recess 24.

Base portion 19 further includes a pin 25, which is biased to extend into recess 24. Pin 25 removably secures arm 14 in recess 24, providing further securement of male closure member 11 with female closure member 12 when these elements are engaged.

In one embodiment, base portion 19 additionally includes a pin housing 26, in which the pin 25 is disposed, and having an aperture 27 through which pin 25 extends into recess 24.

In one embodiment pin 25 is spring loaded. In this embodiment, a spring 28 providing the biasing to pin 25 is disposed in pin housing 26.

The components of closure 10, including male closure member 11, female closure member 12, and pin 25, may be made from any durable, non-deformable and strong material. Such material may be a metal, such as steel, stainless steel, copper or brass, zinc alloy, or plastic.

Spring 28 may be made from any durable, resilient material. The spring material may be, e.g., a metal such as steel, stainless steel, brass, or a resilient plastic.

Items can be removably secured to one another through attachment of one to first loop 13 of male closure member 11 and the other to second loop 18 of female closure member 12. For example, the looped ends of corresponding brassiere straps may be attached to first loop 13 and second loop 18, respectively.

FIGS. 1-7 illustrate varying views of closure 10 and its components.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. A closure, comprising:

a male closure member including a first loop;

an arm fixedly attached to the loop; and a bar fixedly attached to the arm, the bar having an upper portion extending orthogonally from the arm in a first direction and a lower portion extending orthogonally from the arm in a second direction opposite the first direction;

the bar, the arm and the first loop lying substantially in a plane; and a female closure member including a second loop; and a base portion fixedly attached to the second loop, the base portion having a top edge and a bottom edge and a trough extending from the bottom edge to the top edge into which the bar of the male closure member is insertable at the bottom edge and moveable along and configured for rotational pivoting of the bar in the trough, the base portion including a trough housing for receiving the upper portion of the bar inserted in the trough, the base portion having a recess configured to receive the arm attached to the bar inserted in the trough and positioned such that the upper portion of the bar is received by the trough housing, and the upper portion of the bar and the lower portion of the bar are disposed between the top edge and the bottom edge, the base portion including a spring and a spring loaded pin biased to extend into the recess and configured to removably secure the arm in the recess, wherein the spring and the spring loaded pin are oriented in a direction perpendicular to the top edge of the base portion.

2. The closure of claim 1 wherein the base portion of the female closure member includes a pin housing in which the spring loaded pin is disposed and having an aperture through which the spring loaded pin extends into the recess.

3. The closure of claim 1 wherein the male closure member and the female closure member are formed from metal or plastic.

* * * * *